US008726450B2

(12) United States Patent
Hoffmann

(10) Patent No.: US 8,726,450 B2
(45) Date of Patent: May 20, 2014

(54) SCRAPER SYSTEM AND METHODS

(75) Inventors: Wilfred J. Hoffmann, Fort Smith, AR (US); Gloria Hoffmann, legal representative, Fort Smith, AR (US)

(73) Assignee: Homax Products, Inc., Bellingham, WA (US)

( * ) Notice: Subject to any disclaimer, the term of this patent is extended or adjusted under 35 U.S.C. 154(b) by 1300 days.

(21) Appl. No.: 12/069,367

(22) Filed: Feb. 7, 2008

(65) Prior Publication Data

US 2008/0209657 A1 Sep. 4, 2008

Related U.S. Application Data

(60) Provisional application No. 60/900,063, filed on Feb. 7, 2007.

(51) Int. Cl.
*A47L 13/02* (2006.01)

(52) U.S. Cl.
USPC ..... 15/236.05; 15/236.01; 15/236.06

(58) Field of Classification Search
USPC ..... 15/236.01, 236.06
IPC ..... A47L 13/02
See application file for complete search history.

(56) References Cited

U.S. PATENT DOCUMENTS

| | | | | |
|---|---|---|---|---|
| 693,518 | A * | 2/1902 | Hamilton | 30/172 |
| 912,028 | A | 2/1909 | Prout | |
| 1,390,126 | A | 9/1921 | Halaska, Jr. | |
| 1,401,457 | A | 12/1921 | Beuckmann | |
| 1,436,254 | A | 11/1922 | Henry | |
| 1,602,642 | A | 10/1926 | Brathwaite | |
| 1,674,510 | A | 6/1928 | Hagman | |
| 1,919,865 | A | 8/1932 | Schacht | |
| 2,046,599 | A | 7/1936 | Andrews | |
| 2,188,114 | A | 1/1940 | Hubbard | |

(Continued)

FOREIGN PATENT DOCUMENTS

| | | |
|---|---|---|
| CA | 1210371 | 8/1986 |
| CA | 2145129 | 9/1995 |

(Continued)

OTHER PUBLICATIONS

Homax, Caulk Finisher Product, Website http://www.homaxproducts.com/products/kitchenbath/01/index.html, 1988.

(Continued)

*Primary Examiner* — Monica Carter
*Assistant Examiner* — Stephanie Berry
(74) *Attorney, Agent, or Firm* — Michael R. Schacht; Schact Law Office, Inc.

(57) ABSTRACT

A scraper system for removing caulk beads from at least one surface. The scraper system comprises a handle portion and a scraper portion. The scraper portion comprises a first scraper structure defining a first scraper edge and a second scraper structure defining a second scraper edge. The second scraper edge comprises a first scraper edge portion and a second scraper edge portion, and the first and second scraper edge portions extend at a first angle with respect to each other. The scraper system may be used in a first mode in which the first scraper edge is used to remove caulk beads from the at least one surface and a second mode in which the second scraper edge is used to remove caulk beads from a plurality of surfaces.

14 Claims, 3 Drawing Sheets

(56) References Cited

U.S. PATENT DOCUMENTS 2,197,052 A 4/1940 Lowen
2,271,285 A 1/1942 Bussert
2,272,285 A 1/1942 Bussert
2,280,225 A 4/1942 Finely
2,361,407 A 10/1944 McNair
2,528,911 A 11/1950 Porter
2,674,005 A 4/1954 Simon
2,715,750 A 8/1955 Vail
2,804,767 A 9/1957 Schoen
2,962,743 A 12/1960 Henriksson
2,982,987 A 5/1961 Knapp
3,016,561 A 1/1962 Hulsh
3,032,803 A 5/1962 Walshauser
3,072,953 A 1/1963 Bunke
3,087,654 A 4/1963 Moore
3,121,906 A 2/1964 Hulsh
3,135,007 A 6/1964 Howell
3,271,810 A 9/1966 Raffe
3,688,401 A 9/1972 Harman
3,744,079 A 7/1973 Krause
3,756,732 A 9/1973 Stoffler
3,761,992 A 10/1973 Schneller
3,797,946 A 3/1974 Witzmann et al.
3,846,060 A 11/1974 Otis
3,878,581 A 4/1975 Perna
3,892,039 A * 7/1975 Fisher ..... 30/279.2
4,123,005 A 10/1978 Blunk
4,211,501 A 7/1980 Pedroso et al.
4,230,356 A 10/1980 O'Connor
4,295,242 A 10/1981 Dixon
4,338,718 A 7/1982 Olkkola
4,364,521 A 12/1982 Stankowitz
4,411,387 A 10/1983 Stern et al.
4,502,814 A 3/1985 Trimble
4,586,890 A 5/1986 Marchbanks
4,654,919 A 4/1987 Liberman
4,674,903 A 6/1987 Chen
4,934,854 A 6/1990 Vesely et al.
4,955,545 A 9/1990 Stern et al.
4,961,537 A 10/1990 Stern
4,981,629 A 1/1991 Cook
5,008,970 A 4/1991 Tsai
5,018,956 A 5/1991 Lemaster
5,033,951 A 7/1991 Cook
5,037,011 A 8/1991 Woods
5,069,390 A 12/1991 Stern et al.
5,104,013 A 4/1992 Hawley
D326,593 S 6/1992 Ward
D332,901 S 2/1993 Campbell
5,188,263 A 2/1993 Woods
5,188,295 A 2/1993 Stern et al.
5,310,095 A 5/1994 Stern et al.
5,341,970 A 8/1994 Woods
5,351,357 A 10/1994 Liberman
5,409,148 A 4/1995 Stern et al.
D358,989 S 6/1995 Woods
5,421,519 A 6/1995 Woods
5,437,074 A 8/1995 White et al.
5,440,776 A 8/1995 Kartler
D362,604 S 9/1995 White et al.
5,450,983 A 9/1995 Stern et al.
5,476,879 A 12/1995 Woods et al.
5,489,048 A 2/1996 Stern et al.
5,505,344 A 4/1996 Woods
5,524,798 A 6/1996 Stern et al.
5,577,851 A 11/1996 Koptis
5,638,900 A 6/1997 Lowenstein et al.
5,638,990 A 6/1997 Kastberg
5,639,026 A 6/1997 Woods
5,645,198 A 7/1997 Stern et al.
5,655,691 A 8/1997 Stern et al.
5,675,860 A 10/1997 Campbell
5,695,788 A 12/1997 Woods
5,715,975 A 2/1998 Stern et al.
5,727,736 A 3/1998 Tryon
5,908,644 A 6/1999 Poole
5,921,446 A 7/1999 Stern
5,934,518 A 8/1999 Stern et al.
5,941,462 A 8/1999 Sandor
5,988,923 A 11/1999 Arai
6,000,583 A 12/1999 Stern et al.
D420,882 S * 2/2000 Majolo et al. ..... D8/98
6,035,536 A * 3/2000 Dewberry ..... 30/169
6,095,435 A 8/2000 Greer, Jr. et al.
6,112,945 A 9/2000 Woods
6,116,473 A 9/2000 Stern et al.
6,152,335 A 11/2000 Stern et al.
6,168,093 B1 1/2001 Greer, Jr. et al.
D438,111 S 2/2001 Woods
6,219,878 B1 4/2001 Dewberry
6,225,393 B1 5/2001 Woods
6,244,773 B1 6/2001 Geremia-Nargi
6,276,570 B1 8/2001 Stern et al.
6,284,077 B1 9/2001 Lucas et al.
6,291,536 B1 9/2001 Taylor
6,299,686 B1 10/2001 Mills
6,328,185 B1 12/2001 Stern et al.
6,333,365 B1 12/2001 Lucas et al.
6,334,727 B1 1/2002 Gueret
6,351,888 B1 3/2002 Brown et al.
6,352,184 B1 3/2002 Stern et al.
6,375,036 B1 4/2002 Woods
6,382,474 B1 5/2002 Woods et al.
6,386,402 B1 5/2002 Woods
6,399,687 B2 6/2002 Woods
6,414,044 B2 7/2002 Taylor
6,415,964 B2 7/2002 Woods
6,446,842 B2 9/2002 Stern et al.
D468,980 S 1/2003 Woods
6,536,633 B2 3/2003 Stern et al.
6,578,229 B1 * 6/2003 Dziallas et al. ..... 15/236.05
6,641,005 B1 11/2003 Stern et al.
6,641,864 B2 11/2003 Woods
6,656,886 B1 12/2003 Johnson
6,659,312 B1 12/2003 Stern et al.
6,666,352 B1 12/2003 Woods
6,712,238 B1 3/2004 Mills
6,726,066 B2 4/2004 Woods
6,797,051 B2 9/2004 Woods
6,880,198 B1 4/2005 Hazard
6,883,688 B1 4/2005 Stern et al.
6,905,050 B1 6/2005 Stern et al.
6,910,608 B2 6/2005 Greer, Jr. et al.
6,913,407 B2 7/2005 Greer et al.
7,014,073 B1 3/2006 Stern et al.
7,059,497 B2 6/2006 Woods
7,163,962 B2 1/2007 Woods
7,189,022 B1 3/2007 Greer et al.
7,192,985 B2 3/2007 Woods
7,226,001 B1 6/2007 Stern et al.
7,226,232 B2 6/2007 Greer, Jr. et al.
7,232,047 B2 6/2007 Greer, Jr. et al.
7,240,857 B1 7/2007 Stern et al.
7,278,590 B1 10/2007 Greer, Jr. et al.
7,337,985 B1 3/2008 Greer, Jr. et al.
7,374,068 B2 5/2008 Greer, Jr.
7,481,338 B1 1/2009 Stern et al.
7,487,893 B1 2/2009 Greer, Jr. et al.
7,500,621 B2 3/2009 Tryon et al.
7,597,274 B1 10/2009 Stern et al.
7,600,659 B1 10/2009 Greer, Jr. et al.
D605,911 S * 12/2009 Lian et al. ..... D8/14
7,624,932 B1 12/2009 Greer, Jr. et al.
7,673,816 B1 3/2010 Stern et al.
7,677,420 B1 3/2010 Greer, Jr. et al.
7,744,299 B1 6/2010 Greer et al.
7,784,649 B2 8/2010 Greer, Jr.
7,845,523 B1 12/2010 Greer, Jr. et al.
7,947,753 B2 5/2011 Greer, Jr.
7,950,099 B1 5/2011 Hanson et al.
8,028,864 B2 10/2011 Stern et al.
8,033,484 B2 10/2011 Tryon et al.
8,038,077 B1 10/2011 Greer, Jr. et al.
8,042,713 B2 10/2011 Greer, Jr. et al.

(56) References Cited

U.S. PATENT DOCUMENTS

| | | | |
|---|---|---|---|
| 8,157,135 | B2 | 4/2012 | Stern et al. |
| 8,172,113 | B2 | 5/2012 | Greer, Jr. |
| 8,215,862 | B2 | 7/2012 | Greer, Jr. et al. |
| 8,221,019 | B2 | 7/2012 | Greer, Jr. et al. |
| 8,251,255 | B1 | 8/2012 | Greer, Jr. et al. |
| 8,313,011 | B2 | 11/2012 | Greer, Jr. et al. |
| 8,317,065 | B2 | 11/2012 | Stern et al. |
| 8,336,742 | B2 | 12/2012 | Greer, Jr. et al. |
| 8,342,421 | B2 | 1/2013 | Greer, Jr. et al. |
| 8,353,465 | B2 | 1/2013 | Tryon et al. |
| 8,420,705 | B2 | 4/2013 | Greer, Jr. |
| 2001/0002676 | A1 | 6/2001 | Woods |
| 2002/0119256 | A1 | 8/2002 | Woods |
| 2004/0099697 | A1 | 5/2004 | Woods |
| 2004/0136770 | A1 | 7/2004 | Muhr-Sweeney |
| 2004/0195277 | A1 | 10/2004 | Woods |
| 2005/0161531 | A1 | 7/2005 | Greer, Jr. et al. |
| 2005/0236436 | A1 | 10/2005 | Woods |
| 2006/0079588 | A1 | 4/2006 | Greer, Jr. |
| 2006/0180616 | A1 | 8/2006 | Woods |
| 2006/0219808 | A1 | 10/2006 | Woods |
| 2006/0219811 | A1 | 10/2006 | Woods |
| 2006/0273207 | A1 | 12/2006 | Woods |
| 2007/0119984 | A1 | 5/2007 | Woods |
| 2007/0219310 | A1 | 9/2007 | Woods |
| 2007/0235563 | A1 | 10/2007 | Woods |
| 2007/0260011 | A1 | 11/2007 | Woods |
| 2008/0209657 | A1 | 9/2008 | Hoffmann |
| 2011/0281030 | A1 | 11/2011 | Greer, Jr. |
| 2012/0064249 | A1 | 3/2012 | Greer, Jr. et al. |
| 2012/0080446 | A1 | 4/2012 | Tryon et al. |
| 2012/0085779 | A1 | 4/2012 | Stern et al. |
| 2012/0091217 | A1 | 4/2012 | Greer, Jr. et al. |
| 2012/0097703 | A1 | 4/2012 | Greer, Jr. et al. |
| 2012/0145751 | A1 | 6/2012 | Greer, Jr. et al. |
| 2012/0273518 | A1 | 11/2012 | Greer, Jr. |
| 2012/0321796 | A1 | 12/2012 | Greer, Jr. et al. |
| 2013/0011560 | A1 | 1/2013 | Greer, Jr. et al. |
| 2013/0022747 | A1 | 1/2013 | Greer, Jr. et al. |
| 2013/0087576 | A1 | 4/2013 | Stern et al. |
| 2013/0102696 | A1 | 4/2013 | Greer, Jr. et al. |

FOREIGN PATENT DOCUMENTS

| | | |
|---|---|---|
| CA | 2090185 | 10/1998 |
| CA | 2291599 | 6/2000 |
| CA | 2381994 | 2/2001 |
| CA | 2327903 | 6/2001 |
| CA | 2065534 | 8/2003 |
| CA | 2448794 | 5/2004 |
| CA | 2504509 | 10/2005 |
| CA | 2504513 | 10/2005 |
| CA | 2224042 | 5/2006 |
| FR | 2792296 | 10/2000 |
| GB | 844416 | 8/1960 |
| GB | 2418959 | 4/2006 |
| WO | 8904796 | 6/1989 |
| WO | 0010446 | 3/2000 |
| WO | WO0012842 | 3/2000 |
| WO | 2008097636 | 8/2008 |

OTHER PUBLICATIONS

USPTO, Office Action, U.S. Appl. No. 12/901,400, Jun. 7, 2011, 7 pages.

Schacht Law Office, Inc., Response, U.S. Appl. No. 23/901,400, Sep. 7, 2011, 8 pages.

USPTO, Office Action, U.S. Appl. No. 12/825,271, May 12, 2011, 8 pages.

Schacht Law Office, Inc., Response, U.S. Appl. No. 12/825,271, Sep. 12, 2011, 8 pages.

Extended European Search Report, including Supplementary European Search Report, dated Jan. 9, 2012; 6 pages.

Dap Products Inc., Website http://www.dap.com/product_details.aspx?BrandID=137&SubcatID=23, "Dap Patch Stick Nail Hole & Crack Filler (RTU)", 1994, 1 page.

Homax Products Inc., "Easy Touch Spray Texture", Mar. 1994, 1 page.

International Searching Authority, "ISR PCT/US2008/001688", Jun. 27, 2008, 13 pages.

* cited by examiner

SCRAPER SYSTEM AND METHODS

RELATED APPLICATIONS

This application, U.S. patent application Ser. No. 12/069,367, filed Feb. 7, 2008, claims priority of U.S. Provisional Patent Application Ser. No. 60/900,063 filed Feb. 7, 2007, the contents of which are incorporated herein by reference.

TECHNICAL FIELD

The present invention relates to scraper systems and methods and, more specifically, to such scraper systems and methods that allow material to be removed from a flat surface and/or a juncture between first and second flat surfaces.

BACKGROUND

Caulk material is often used to cover the gap formed at the juncture of the adjacent edges of two structures to prevent the movement of water, air, dust, insects, sound, and the like through this gap; caulk materials can also increase the fire resistance of a structure. As an example, caulk material is typically used to cover the gap formed at the juncture of two waterproof wall members used to form the walls of a shower stall. With waterproof wall members and caulk extending across the juncture gap, water within the shower stall is prevented from reaching the framing of the structure supporting the shower stall.

Caulk material is typically a flexible compound having both bonding and structural characteristics. In particular, a caulk material is typically designed to bond to the juncture surfaces on either side of a juncture gap. A caulk material is also designed to form a monolithic structure capable of spanning the juncture gap. Certain caulk materials, often referred to as sealants, are designed to deform to accommodate movement of the materials defining the juncture surfaces without breaking the bond with the surfaces on either side of the juncture gap or compromising the monolithic structure extending across the juncture gap.

Caulk materials are typically sold in a container such as a tube or a cartridge. A tip of the tube or cartridge is cut to define an applicator opening, and the caulk material is forced out of the tube or cartridge. Typically, the applicator opening is displaced along a juncture gap as the caulk material is forced out of the container in an elongate bead. The caulk material dries and bonds to the juncture surfaces when exposed to air to form what may be referred to as a caulk bead.

For a variety of reasons, the need may exist to remove an existing caulk bead. Even in situations where the existing caulk bead has failed, at least a partial bond may exist between the caulk bead and the juncture surface or surfaces to which the caulk bead is bonded. A tool is thus typically used to break the bond between the existing caulk bead and the juncture surface to which the caulk bead is bonded.

Typically, a scraper or putty knife, knife, or other thin, relatively rigid tool is used to break the bond between an existing caulk bead and a juncture surface. These tools define an edge that can be inserted between the caulk bead and the juncture surface and drawn along the length of the caulk bead, separating the bead from the juncture surface.

The need exists for improved systems and methods for removing caulk beads from one or more juncture surfaces.

SUMMARY OF THE INVENTION

The present invention may be embodied as a scraper system for removing caulk beads from at least one surface. The scraper system comprises a handle portion and a scraper portion. The scraper portion comprises a first scraper structure defining a first scraper edge and a second scraper structure defining a second scraper edge. The second scraper edge comprises a first scraper edge portion and a second scraper edge portion, and the first and second scraper edge portions extend at a first angle with respect to each other. The scraper system may be used in a first mode in which the first scraper edge is used to remove caulk beads from the at least one surface and a second mode in which the second scraper edge is used to remove caulk beads from a plurality of surfaces.

DETAILED DESCRIPTION OF THE INVENTION

Figure 1:
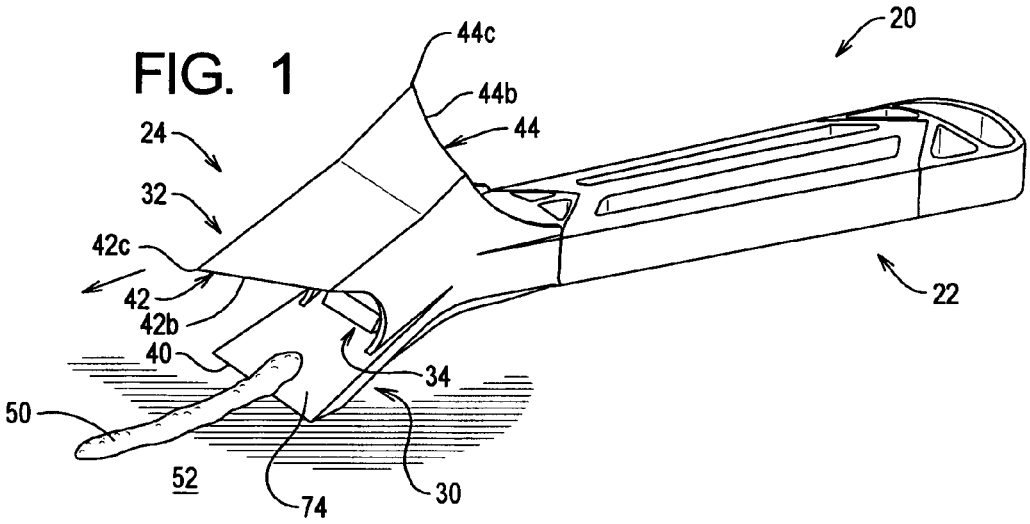
FIG. 1 is a perspective view of an example scraper tool of the present invention in a first mode of operation.
Figure 2:
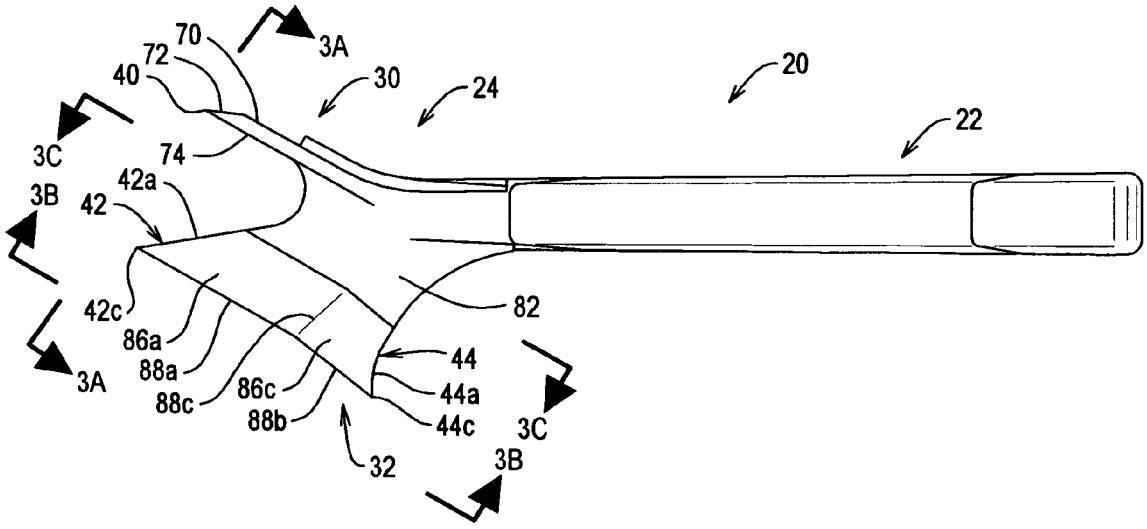
FIG. 2 is a side elevation view of the scraper tool of FIG. 1.

FIGS. 1-5 of the drawing depict a scraper tool 20 constructed in accordance with, and embodying, the principles of the present invention. The scraper tool 20 comprises a handle portion 22 and a scraper portion 24. The scraper portion 24 defines a first scraper structure 30 and a second scraper structure 32. The scraper portion 24 further defines a scraper cavity 34.

The first scraper structure 30 defines a first scraper edge 40. The second scraper structure 32 defines a second scraper edge 42 and a third scraper edge 44. The second scraper edge 42 defines first and second scraper edge portions 42*a* and 42*b* and a first scraper point 42*c*. The third scraper edge 44 defines third and fourth scraper edge portions 44*a* and 44*b* and a second scraper point 44*c*.

As shown in FIG. 1, the scraper tool 20 may be used in a first mode to remove a bead 50 of material from a surface 52. In this example, the surface 52 is flat, and the first scraper edge 40 is displaced along the surface 52 such that the bond between the bead 50 and the surface 52 is broken. The material of the removed bead 50 moves into the scraper cavity 34 where it is collected for subsequent disposal.

Figure 4:
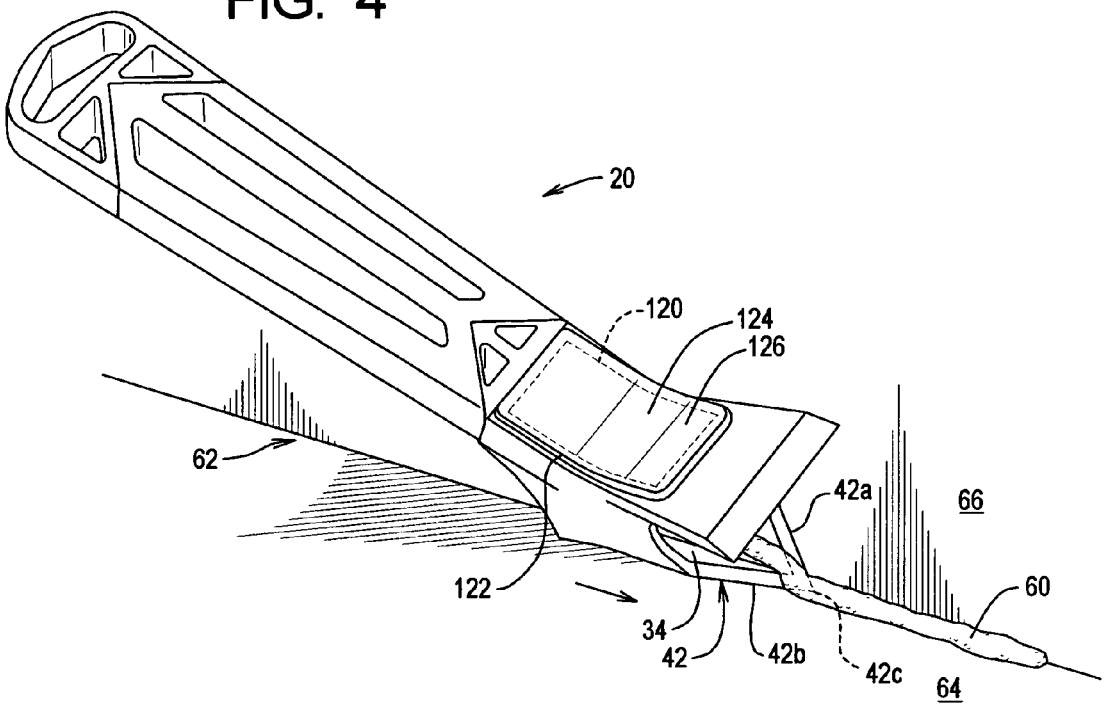
FIG. 4 is a perspective view of the example scraper tool of FIG. 1 in a second mode of operation.

As shown in FIG. 4, the scraper tool 20 may be used in a second mode to remove a bead 60 of material from a corner region 62 formed by two surfaces 64 and 66. In this second mode, the second scraper point 42c is brought into contact with the corner region 62 such that one or both of the scraper edge portions 42*a* and 42*b* engage the surfaces 64 and 66. The second scraper edge 42 is then displaced along the corner region 62 such that the bond between the bead 60 and the surfaces 64 and 66 is broken. The material of the removed bead 60 moves into the scraper cavity 34 where it is collected for subsequent disposal.

Figure 5:
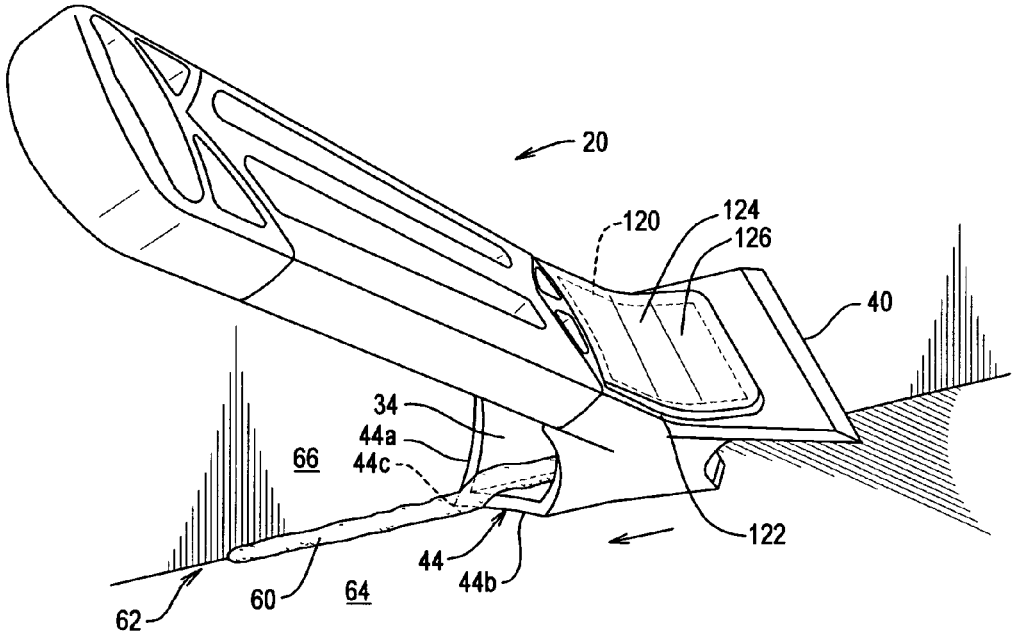
FIG. 5 is a perspective view of the example scraper tool of FIG. 1 in a third mode of operation.

As shown in FIG. 5, the scraper tool 20 may be used in a third mode to remove a bead 60 of material from a corner region 62 formed by two surfaces 64 and 66. In this third mode, the third scraper point 44*c* is brought into contact with the corner region 62 such that one or both of the scraper edge portions 44*a* and 44*b* engage the surfaces 64 and 66. The third scraper edge 44 is then displaced along the corner region 62 such that the bond between the bead 60 and the surfaces 64 and 66 is broken. The material of the removed bead 60 moves into the scraper cavity 34 where it is collected for subsequent disposal.

The example scraper tool 20 can thus be used the first mode to remove a bead of material from a flat surface and in one or both of the second and third modes to remove a bead of material from a corner region as is appropriate for a particular set of circumstances. With respect to removing a bead of material from a corner region, some times the tool 20 may be used more easily by pushing the scraper tool 20 with the handle portion 22 using the second scraper edge 42 and sometimes by pulling the scraper tool 20 with the handle portion 22 using the third scraper edge 44.

With the foregoing general understanding of the user of the example scraper tool 20, the details of construction of the example scraper tool 20 will now be described.

The example first scraper structure 30 is a substantially planar, and the first scraper edge 40 is substantially straight. The first scraper structure 30 defines a proximal surface 70, a distal surface 72, and a bottom surface 74. The first scraper structure is beveled such that a thickness dimension thereof is relatively constant between the proximal surface 70 and the bottom surface 74 but decreases between the distal surface 72 and the bottom surface 74.

Figure 3A:
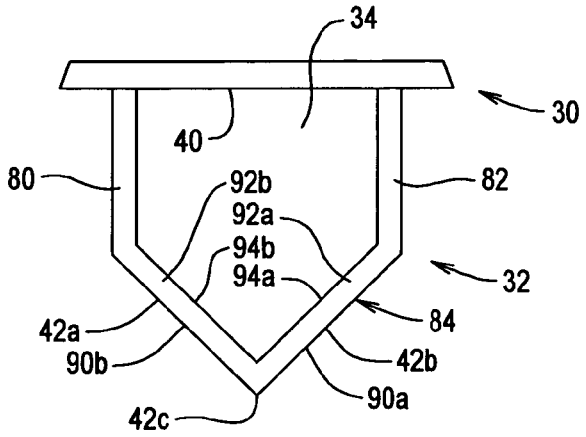
FIG. 3A is a view taken along lines 3A-3A in FIG. 2.
Figure 3B:
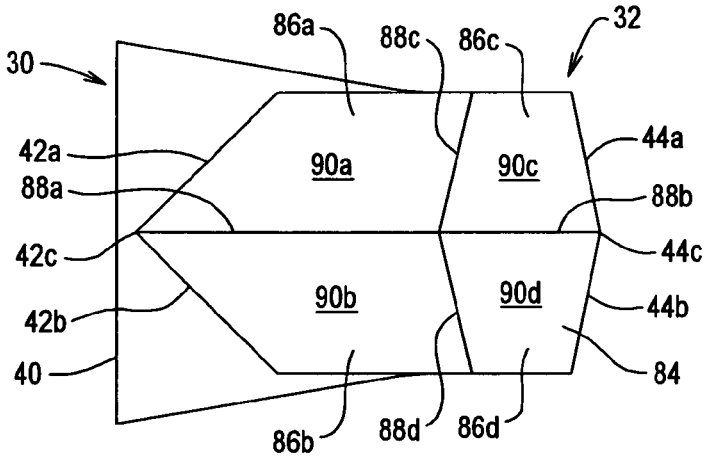
FIG. 3B is a view taken along lines 3B-3B in FIG. 2.
Figure 3C:
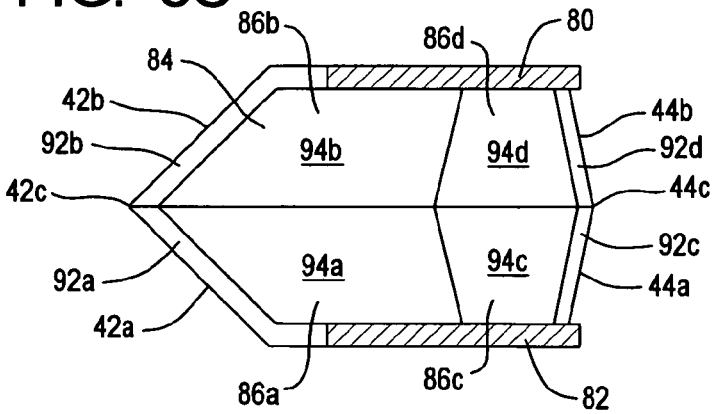
FIG. 3C is a view taken along lines 3C-3C in FIG. 2.

Referring more specifically to FIGS. 3A and 3B, the example second scraper structure 32 comprises first and second side walls 80 and 82 and a bottom wall 84 defining first, second, third, and fourth wall portions 86*a*, 86*b*, 86*c*, and 86*d*. The example bottom wall portions 86*a-d* extend at angles relative to each other such that the second scraper structure 32 defines first, second, third, and fourth crease edges 88*a*, 88*b*, 88*c*, and 88*d*.

In addition, the example wall portions 86*a-d* define first, second, third, and fourth outer surfaces 90*a*, 90*b*, 90*c*, and 90*d*, first, second, third, and fourth edge surfaces 92*a*, 92*b*, 92*c*, and 92*d*, and first, second, third, and fourth inner surfaces 94*a*, 94*b*, 94*c*, and 94*d*, respectively. The first wall portion 86*a* defines the first scraper edge portion 42*a*, the second wall portion 86*b* defines the second scraper edge portion 42*b*, the third wall portion 86*c* defines the third scraper edge portion 44*a*, and the fourth wall portion 86*d* defines the fourth scraper edge portion 44*b*.

The wall portions 86 are beveled such that thickness dimensions thereof are relatively constant between the outer surfaces 90 and the inner surfaces 94 but decreases between the edge surfaces 92 and the inner surfaces 94.

In the example scraper tool 20, the crease edges 88*a* and 88*b* extend with respect to each other at a first angle. The first angle is approximately 169 degrees and, if implemented, should be within an example range of substantially between 159 and 179 degrees.

The example first and second wall portions 86*a* and 86*b* are substantially planar and extend from each other at a second angle. The example second angle is approximately 90 degrees and should be within an example range of substantially between 85 and 95 degrees.

The example third and fourth wall portions 86*c* and 86*d* are also substantially planar and extend from each other at a third angle. The example third angle is approximately 90 degrees and should be within an example range of substantially between 85 and 95 degrees.

The first and third wall portions 86*a* and 86*c* extend from each other at a fourth angle, while the second and fourth wall portions 86*b* and 86*d* extend from each other at a fifth angle. The example fourth angle is approximately 169 degrees and, if implemented, should be within an example range of substantially between 159 and 179 degrees. The example fifth angle is approximately 169 degrees and, if implemented, should be within an example range of substantially between 159 and 179 degrees.

The details of construction and operation of the handle portion 22 is not essential to the construction and operation of the scraper tool 20. Any handle portion that facilitates use of a scraper tool of the present invention may be substituted for the handle portion 22 described and depicted herein.

In addition, the example scraper tool 20 is manufactured with an opening 120 formed in opposing wall 122 of the tool 20. The opposing wall 122 is opposite the bottom wall 84 of the second scraper structure 32. The opening 120 facilitates the manufacture of the scraper tool 20 using an injection molding process. A cover member 124 engages the wall 122 to cover the opening 120 and thus provide a leverage surface 126 that facilitates application of force during use of the scraper tool 20. The use of an opening 120 and cover member 124 are optional, and the present invention may be implemented without these features.

The scope of the present invention should be determined by the claims appended hereto and not the detailed description of examples of the present invention as discussed above.

What is claimed is:

1. A scraper system for removing caulk beads from at least one surface, comprising:

a handle portion; and a scraper portion arranged on a first end of the handle portion and defining a scraper cavity, the scraper portion comprising a first scraper structure that extends from the handle portion and defines a distal surface and a bottom surface that define a first scraper edge, where the first scraper structure is beveled between the distal surface and the bottom surface, and the bottom surface is angled with respect to the handle portion, and a second scraper structure defining a second scraper edge comprising a first scraper edge portion and a second scraper edge portion, where the first and second scraper edge portions extend at a first angle with respect to each other; whereby the scraper system may be used in a first mode in which the first scraper edge is used to remove caulk beads from the at least one surface; and a second mode in which the second scraper edge is used to remove caulk beads from a plurality of surfaces;

when used in the first and second modes, at least a portion of the caulk beads removed by the first scraper structure and the second scraper structure collects in the scraper cavity; and the second scraper edge defines a first scraper point, where the first and second scraper edge portions intersect at the first scraper point.

2. A scraper system as recited in claim 1, in which:

the second scraper structure further comprises a third scraper edge comprising a third scraper edge portion and a fourth scraper edge portion, where the third and fourth scraper edge portions extend at a second angle with respect to each other; whereby the scraper system may be used in a third mode in which the third scraper edge is used to remove caulk beads from a plurality of surfaces; and when used in the third, at least a portion of the caulk beads removed by the second scraper structure collects in the scraper cavity.

3. A scraper system as recited in claim 2, in which the first and second angles are different.

4. A scraper system as recited in claim 1, in which:

a third scraper edge defines a second scraper point, where a third scraper edge portion and a fourth scraper edge portion intersect at the second scraper point.

5. A scraper system as recited in claim 1, in which:

the second scraper structure defines a scraper cavity; and when caulk beads are removed from the at least one surface, removed caulk material is collected in the scraper cavity.

6. A scraper system as recited in claim 1, in which:

a third scraper edge defines a second scraper point; and at least one crease edge extends between the first and second scraper points.

7. A scraper system as recited in claim 4, in which first and second crease edges extend between the first and second scraper points.

8. A scraper system as recited in claim 7, in which the first and second crease edges extend from each other at an angle of substantially between 159 and 179 degrees.

9. A scraper system as recited in claim 1, in which the second scraper structure defines first and second side walls and a bottom wall.

10. A scraper system as recited in claim 1, in which the second scraper structure defines a bottom wall comprising first, second, third, and fourth wall portions.

11. A method of removing caulk beads from at least one surface, comprising the steps of:

providing a tool comprising a handle portion and a scraper portion, where the scraper portion is arranged on a first end of the handle portion, defines a scraper cavity, and comprises a first scraper structure that extends from the handle portion and defines a distal surface and a bottom surface that define a first scraper edge, where the first scraper structure is beveled between the distal surface and the bottom surface, and the bottom surface is angled with respect to the handle portion, and a second scraper structure defining second scraper edge comprising a first scraper edge portion and a second scraper edge portion, where the first and second scraper edge portions extend at a first angle with respect to each other, and a third scraper edge, where the third scraper edge comprises a third scraper edge portion and a fourth scraper edge portion, and the third and fourth scraper edge portions extend at a second angle with respect to each other;

using the tool in a first mode in which the first scraper edge removes caulk beads from the at least one surface, where at least a portion of the caulk beads removed by the first scraper structure collects in the scraper cavity when the tool is used in the first mode;

using the tool in a second mode in which the second scraper edge removes caulk beads from a plurality of surfaces, where at least a portion of the caulk beads removed by the second scraper structure collects in the scraper cavity when the tool is used in the second mode; and using the tool in a third mode in which the third scraper edge removes caulk beads from a plurality of surfaces, where at least a portion of the caulk beads removed by the second scraper structure collects in the scraper cavity when the tool is used in the third mode.

12. A scraper system for removing caulk beads from at least one surface, comprising:

a handle portion; and a scraper portion arranged on a first end of the handle portion and defining a scraper cavity, the scraper portion comprising a first scraper structure that extends from the handle portion and defines a distal surface and a bottom surface that define a first scraper edge, where the first scraper structure is beveled between the distal surface and the bottom surface, and the bottom surface is angled with respect to the handle portion, and a second scraper structure defining a second scraper edge comprising a first scraper edge portion and a second scraper edge portion, where the first and second scraper edge portions extend at a first angle with respect to each other, and a third scraper edge comprising a third scraper edge portion and a fourth scraper edge portion, where the third and fourth scraper edge portions extend at a second angle with respect to each other; whereby the scraper system may be used in a first mode in which the first scraper edge is used to remove caulk beads from the at least one surface, a second mode in which the second scraper edge is used to remove caulk beads from a plurality of surfaces, and a third mode in which the third scraper edge is used to remove caulk beads from a plurality of surfaces; and when used in the first, second, and third modes, at least a portion of the caulk beads removed by the first scraper structure and the second scraper structure collects in the scraper cavity.

13. A scraper system as recited in claim 12, in which the first and second angles are different.

14. A scraper system as recited in claim 12, in which:

the second scraper edge defines a first scraper point, where the first and second scraper edge portions intersect at the first scraper point; and the third scraper edge defines a second scraper point, where the third and fourth scraper edge portions intersect at the second scraper point.

* * * * *